US005094014A

United States Patent [19]

Schnyder

[11] Patent Number: 5,094,014

[45] Date of Patent: Mar. 10, 1992

[54] DEVICE FOR DRYING SMALL PIECES

[75] Inventor: Hans Schnyder, Nürnberg, Fed. Rep. of Germany

[73] Assignee: Gebrüder Decker KG, Nuremberg, Fed. Rep. of Germany

[21] Appl. No.: 617,746

[22] Filed: Nov. 26, 1990

[30] Foreign Application Priority Data

Nov. 30, 1989 [DE] Fed. Rep. of Germany ..... 3939601

[51] Int. Cl.[5] ..... F26B 21/06

[52] U.S. Cl. ..... 34/77; 34/133 R

[58] Field of Search ..... 34/130, 131, 133, 73, 34/76, 77

[56] References Cited

U.S. PATENT DOCUMENTS 2,676,418 4/1954 Shewmon ..... 34/77
3,002,287 10/1961 Smith ..... 34/77
3,676,937 7/1972 Janson ..... 34/77
3,768,173 10/1973 Jessup et al. ..... 34/133
3,905,122 9/1975 Ohshima et al. ..... 34/60
4,287,672 9/1981 Henig ..... 34/77
4,447,965 5/1984 Bray ..... 34/77
4,785,759 11/1988 Motoyama et al. ..... 34/133

*Primary Examiner*—Henry A. Bennett
*Assistant Examiner*—Denise L. F. Gromada
*Attorney, Agent, or Firm*—Browdy and Neimark

[57] ABSTRACT

A device for the drying of small pieces has a barrel rotatable about a horizontal central longitudinal axis. So as to produce a uniform air flow over the full length of the barrel, a transverse-flow blower is provided, of which the rotor wheel has a length about equalling the length of the barrel and of which the axis of rotation extends parallel to the axis of the barrel.

28 Claims, 5 Drawing Sheets

DEVICE FOR DRYING SMALL PIECES

FIELD OF THE INVENTION

The invention relates to a device for an at least partial drying of small pieces present in a charge and wetted with a treatment bath solution, having a barrel for taking up the charge, which barrel has end faces, a barrel coat provided with openings, and a substantially horizontal central longitudinal axis, with a drying chamber containing the barrel, which drying chamber has limiting walls arranged parallel to the central longitudinal axis, and with a blower with means to actuate the barrel with an air flow directed substantially vertically downwards, and with a housing having an air inlet nozzle and an air outlet nozzle leading to an upper area of the barrel.

BACKGROUND OF THE INVENTION

A device of this kind is known from U.S. Pat. No. 4,287,672 using turbo-blowers as fans for the actuation of the barrel with an air current. It appeared that the drying of the small pieces of a charge is not satisfying and, in particular, takes a lot of time.

SUMMARY OF THE INVENTION

It is an object of the present invention to embody a device of the generic type in such a way that a good and uniform drying of all the small pieces of a charge is realized in as short a time as possible, at the same time necessitating only little space.

This object is attained in accordance with the invention by the blower being a transverse-flow blower with a cylindrical rotor wheel provided with blades projecting substantially radially and rotatingly drivable about an axis of rotation, the axis of rotation being arranged substantially parallel to the central longitudinal axis of the barrel, and the length of the rotor wheel substantially equalling the length of the barrel. The transverse-flow blow used and arranged according to the invention has the effect that the whole charge is uniformly actuated with an air current over the full length of the barrel, whether the air flows around the barrel or is sucked through the charge or is pressed through the charge. Since such transverse-flow blowers have a small diameter in relation to their length, the total device can be designed very compact.

Numerous advantages and features of the invention will become apparent from the ensuing description of three examples of embodiment, taken in conjunction with the drawing.

DESCRIPTION OF THE PREFERRED EMBODIMENTS

Figure 1:
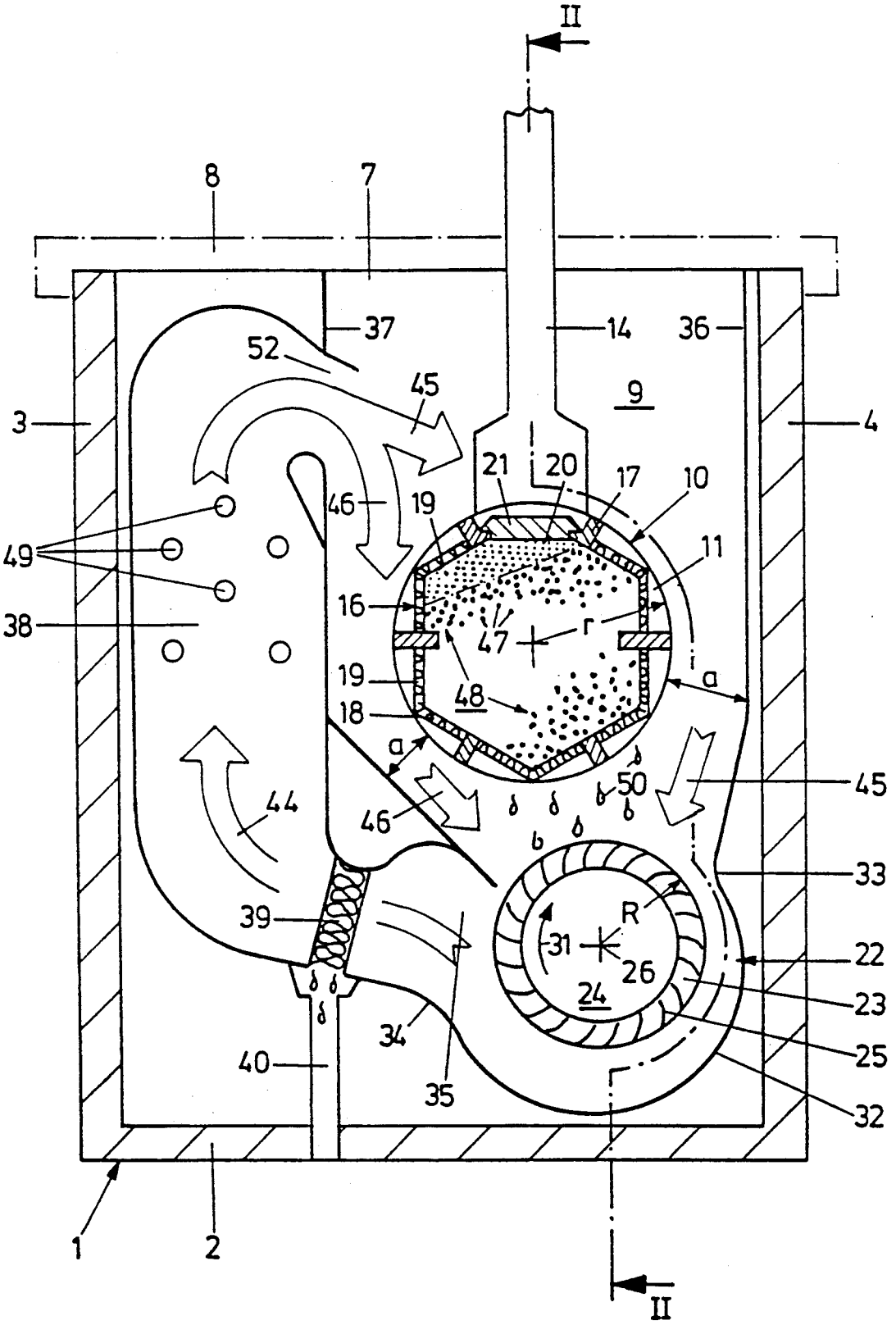
FIG. 1 is a vertical cross-section of a device according to the invention.
Figure 2:
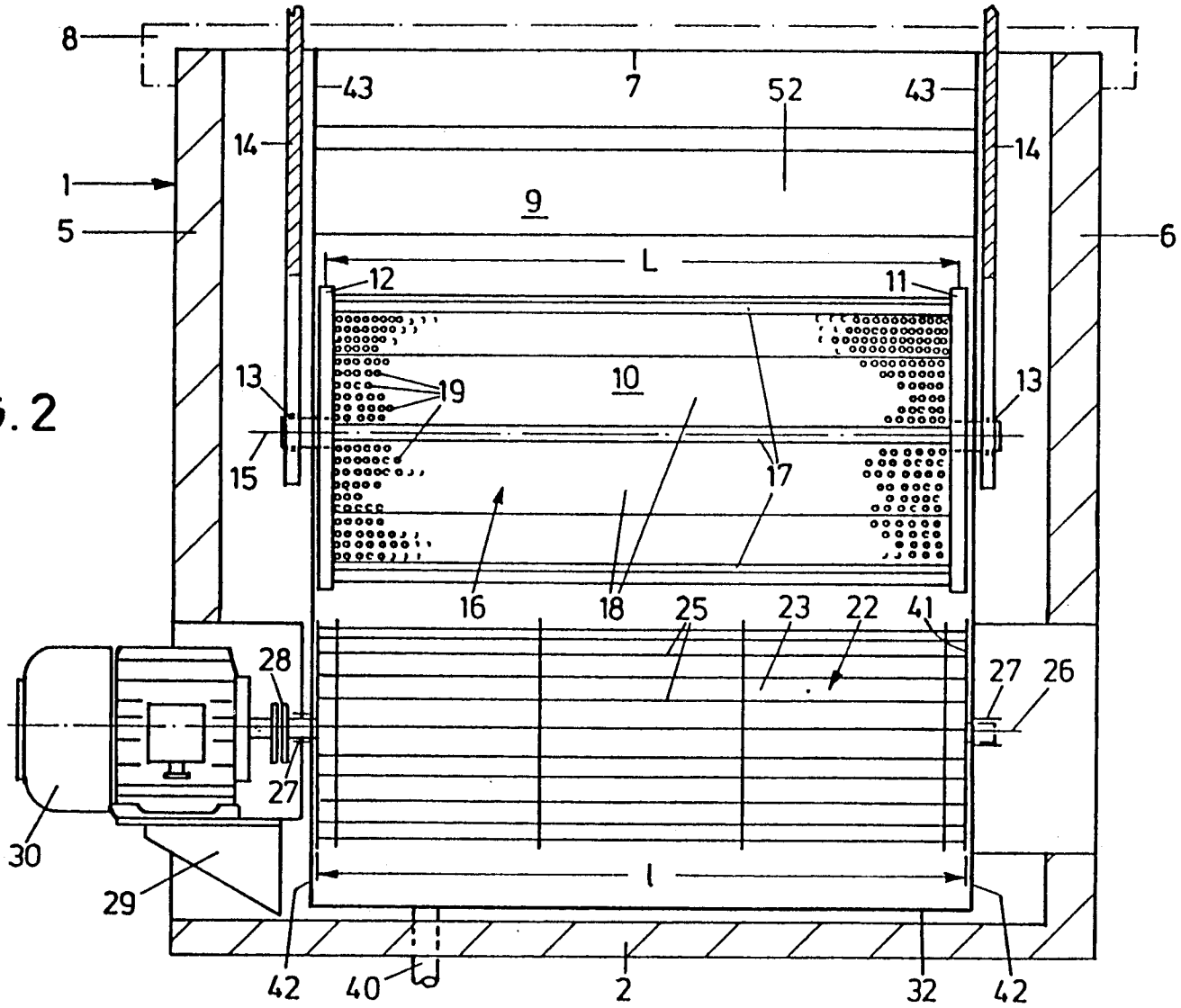
FIG. 2 is a vertical longitudinal section of the device according to FIG. 1 according to the section line II—II in FIG. 1.

The dryer shown in FIGS. 1 and 2 has an approximately cuboidal housing 1 which is at least largely closed by way of a bottom 2 and vertical side walls 3, 4, 5, 6 facing each other two by two. An upper opening 7 can be closed by means of a removable cover 8.

A drying chamber 9 still to be described below is provided in the housing 1. A drying barrel 10 can be introduced into this drying chamber 9 through the opening 7 from above. This barrel 10 has end faces 11, 12 supported by rotary bearings 13 on supporting arms 14 and rotatable around a horizontal central longitudinal axis 15 of the barrel 10. Between the end faces 11, 12 the barrel 10 has a barrel coat or shell 16 provided with support bars 17 connecting the end faces 11, 12. Barrel coat sections 18 having small openings 19 for the passage of air and liquid are arranged between adjacent support bars 17. A charge and discharge opening 20, which can be tightly closed by a cover 21, is arranged between two adjacent support bars 17. The dryer as described above is basically known. That is why the upper suspension of the supporting arms 14 and a rotary drive motor of the barrel 10 are not shown.

A transverse-flow blower 22 is arranged approximately below the barrel 10, which can be removed from the housing 1 upwards, and has an essentially cylindrical rotor wheel 23, of which the length 1 approximately equals the length L of the barrel and of which the radius R is clearly smaller than the length 1. This rotor wheel 23 has a cylindrical rotor body 24 provided on its outer circumference with blades 25 extending over the full length L of the rotor body 24 and thus of the rotor wheel 23. The rotor wheel 23 is rotatably drivable about a horizontal axis of rotation 26 extending parallel to the axis 15 of the barrel 10. The rotor body 24 is supported in bearings 27 in a manner rotatable about the axis of rotation 26 and stationary in the housing 1. It is driven via a coupling 28 by an electric drive motor 30 supported on a pillow block 29 in the housing 1. The rotor wheel is rotatably drivable in a direction of rotation 31 shown to be clockwise in FIG. 1.

The rotor wheel 23 is located in a blower housing 32 having an air inlet nozzle 33 and an air outlet nozzle 34 in the form of a diffuser 35. The inlet nozzle 33 and the outlet nozzle 34 extend over the full length 1 of the rotor wheel 23. The inlet nozzle 33 passes into limiting walls 36, 37 of the drying chamber 9 extending parallel to the axes 15 and 26, i.e. the drying barrel 10 is located directly ahead of the air inlet nozzle 33. The air outlet nozzle 34 with diffuser 35 following the air inlet nozzle 33 by about three quadrants in the direction of rotation 31 of the rotor wheel 23 opens into an air feedback channel 38, which leads back into the drying chamber 9 through the one limiting wall 37 on the side of the barrel 10 opposite the air inlet nozzle. A liquid precipitator 39 with a liquid discharge channel 40 is provided where the diffuser 35 passes into the feedback channel 38.

The blower housing 32 is closed at its front ends, i.e. directly in front of the end sides 41 of the rotor wheel, by housing end faces 42 passing directly into the drying chamber side walls 43, which, together with the limiting walls 36, 37, delimit the drying chamber 9 and which correspondingly also close the air inlet nozzle 33 and the air outlet nozzle 34 laterally.

On the side facing the air inlet nozzle 33 the limiting walls 36, 37 enclose the barrel 10 in the kind of a partial housing at an average distance a which is clearly smaller than the radius r of the barrel 10.

When the rotor wheel 23 is rotatingly driven in the direction of rotation 31, the blades 25 projecting radially outwards in the direction of rotation 31 suck air through the air inlet nozzle 33, and this is done uniformly over the full length 1 of the rotor wheel 23 with the blades 25. When flowing through the blower housing 32 the air is accelerated without any substantial increase in pressure taking place, i.e. in accordance with the usual characteristics of such transverse-flow blowers 22 with roll-shaped or cylinder-shaped rotor wheels 23 there is no increase in pressure taking place in the blower housing 32 itself, but only an increase in speed of the air conveyed. The pressure of the air flowing at a comparatively high speed from the air outlet nozzle 34 into the diffuser 35 according to the air-flow arrow 44 is increased in the diffuser, whereby the flowing speed of the air is simultaneously reduced. This air flows through the air feedback channel 38 and enters into the drying chamber 9, where it splits up into two partial air flows 45, 46 flowing around the barrel 10, with the direction of flow going essentially downwards. The comparatively small distance a of the drying chamber side walls 43 from the barrel coat 16 ensures that these partial flows 45, 46 closely surround the barrel coat 16.

The barrel 10 contains a charge 48 of small pieces 47 to be dried. The small pieces 47 are wetted by a preceding chemical or electrolytic treatment with a treatment bath solution, which is to be dried. The air warmed or heated by a heating 49 flows around the barrel in the manner described above and thus warms up the charge 48, the heat transfer taking place rapidly and intensively through the numerous openings 19 in the barrel coat 16 onto the charge 48 and within the charge 48 from one small piece 47 to another. Thus a drying of the charge 48 takes place. The air enriched with liquid droplets 50 and with steam of the liquid to be dried from the charge 48 flows through the blower 22 in the manner described. The liquid is substantially discharged in the precipitator 39 subsequently arranged and consequently the air is fed back correspondingly dry into the drying process. Due to the comparatively high flow resistance of the very small openings 19 and due to the high flow resistance of the charge 48 no substantial quantity of air flows through the charge itself.

Figure 3:
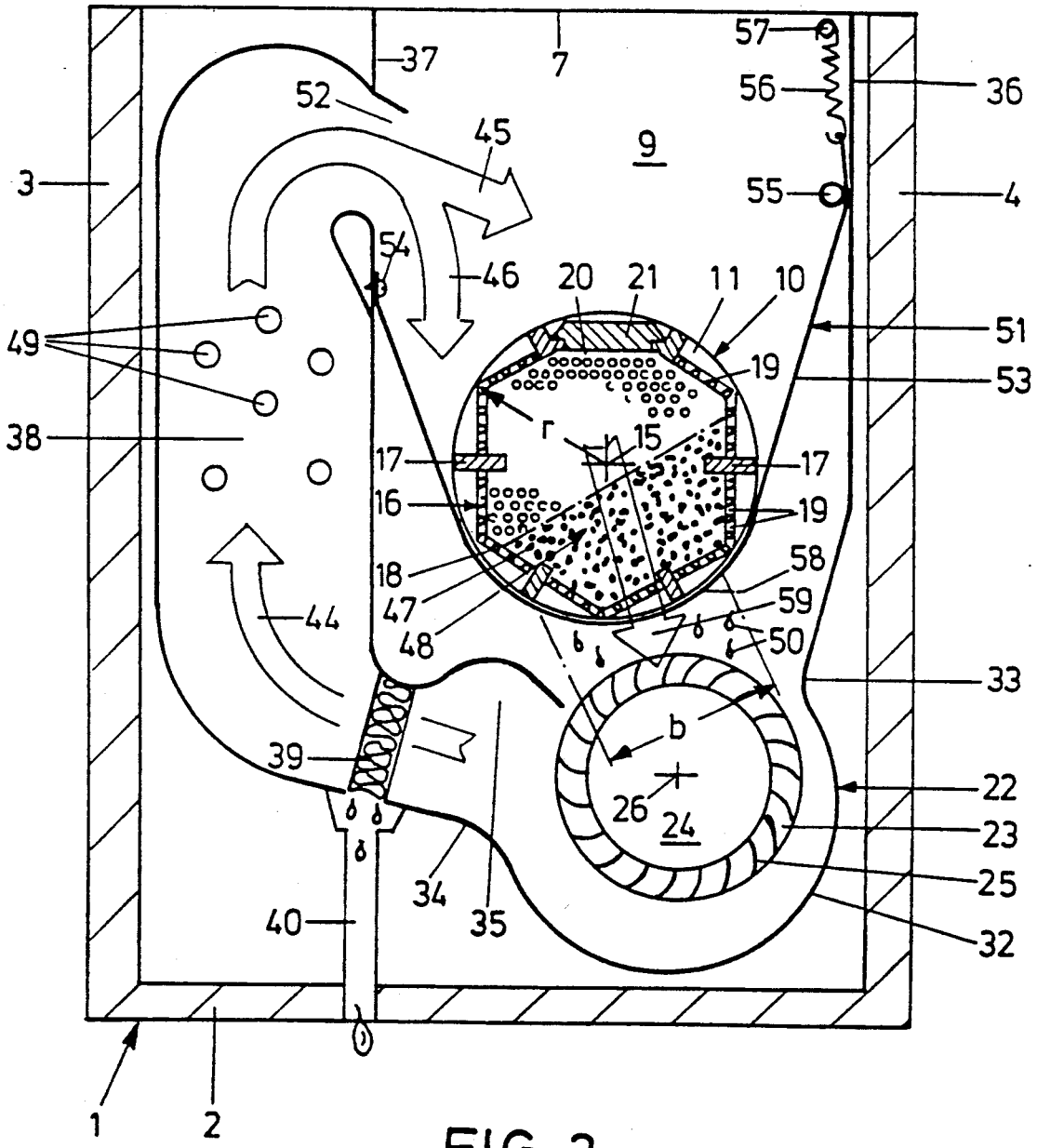
FIG. 3 is a vertical cross-section through a modified device according to the invention.

The example of embodiment according to FIG. 3 only differs from the exemplary embodiment according to FIGS. 1 and 2 in that air guiding devices 51 are arranged in the drying chamber 9, by means of which the air entering from the feedback channel 38 through the inlet opening 52 into the drying chamber 9 is forced to flow through the barrel 10 and the charge 48 contained in the latter. These devices 51 are essentially formed by a membrane 53 which consists for example of spring steel and which is secured by means of screws 54 somewhat below the inlet opening 52 of the limiting wall 37. It surrounds the barrel 10 in the kind of a funnel and is subsequently guided around a tube 55 extending over the full length of the drying chamber 9 with little distance from the limiting wall 36. Its free end located above this tube 55 is secured via tension springs 56 by means of screws 57 laterally in the outer area of the housing 1. This tensioning ensures that the membrane 53 lies close to the barrel in the described manner, i.e. it clings to it. On its side facing the inlet nozzle 33 of the blower 22 the membrane 53 has an air passage opening 58 which extends substantially over the full length of the barrel 10 and of which the width b at right angles to the axis 15 is smaller than the double radius r of the barrel 10. In this respect $r<b<2r$ applies. The air flows through the charge 48 and when doing so in direct contact with the small pieces 47 it assumes from them and takes along the liquid to be dried and flows according to the air flow arrow 59 through the air passage opening 58 into the air inlet nozzle 33 of the transverse-flow blower 22. If the charge 48 fills the barrel 10 to less than its half, $r<b<1.6r$ should apply so that the opening 58 be filled by the charge 48. It is thus ensured that the air flowing downwards is forced to flow through the charge 48 thus blowing out the liquid droplets 50.

Since the radius R of the rotor wheel 23 is clearly smaller than the radius r of the barrel 10, the dryer is very compact in structure.

Figure 4:
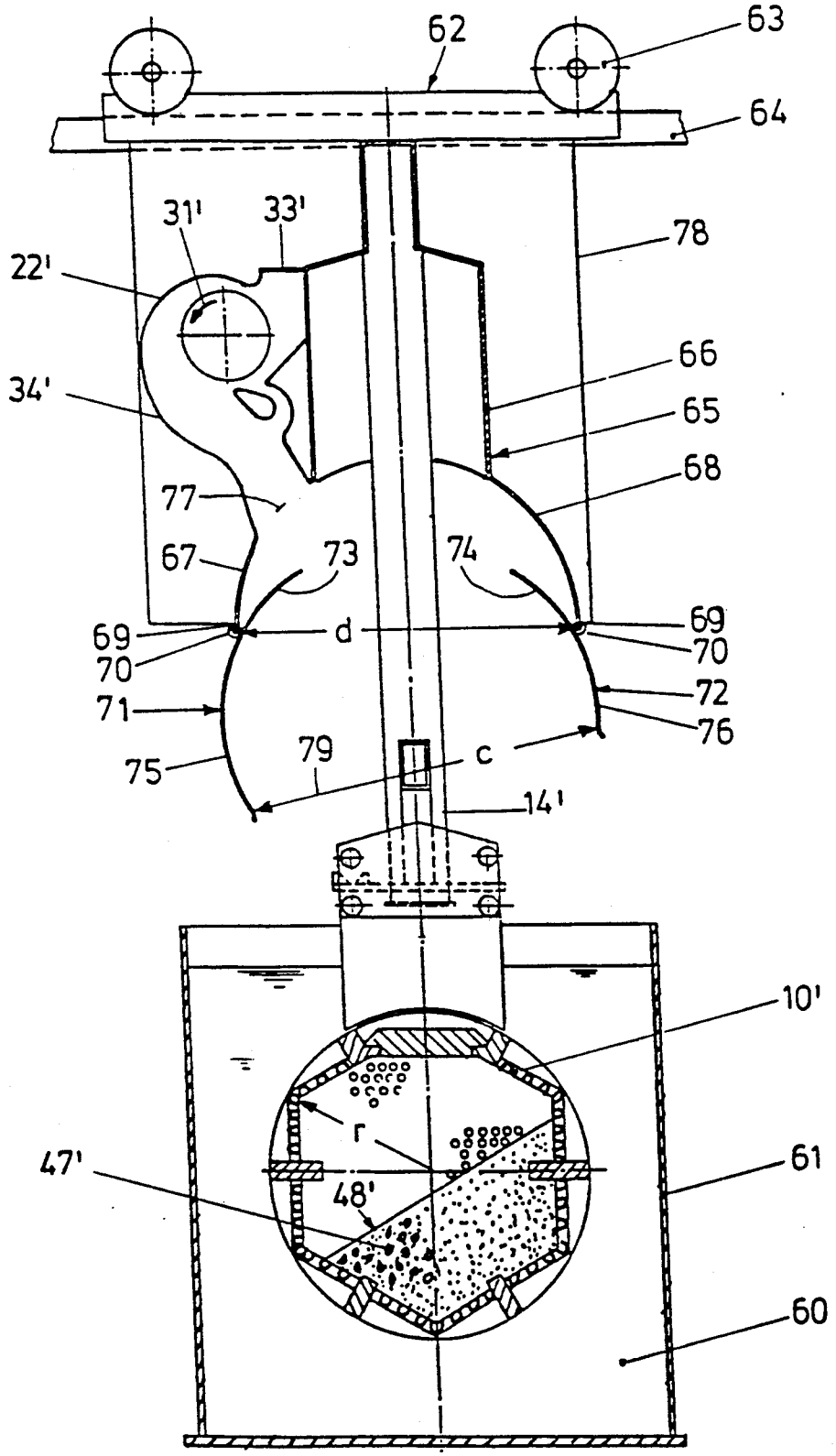
FIG. 4 is a vertical cross-section through a further embodiment of a device according to the invention with the barrel immersed in a container.
Figure 5:
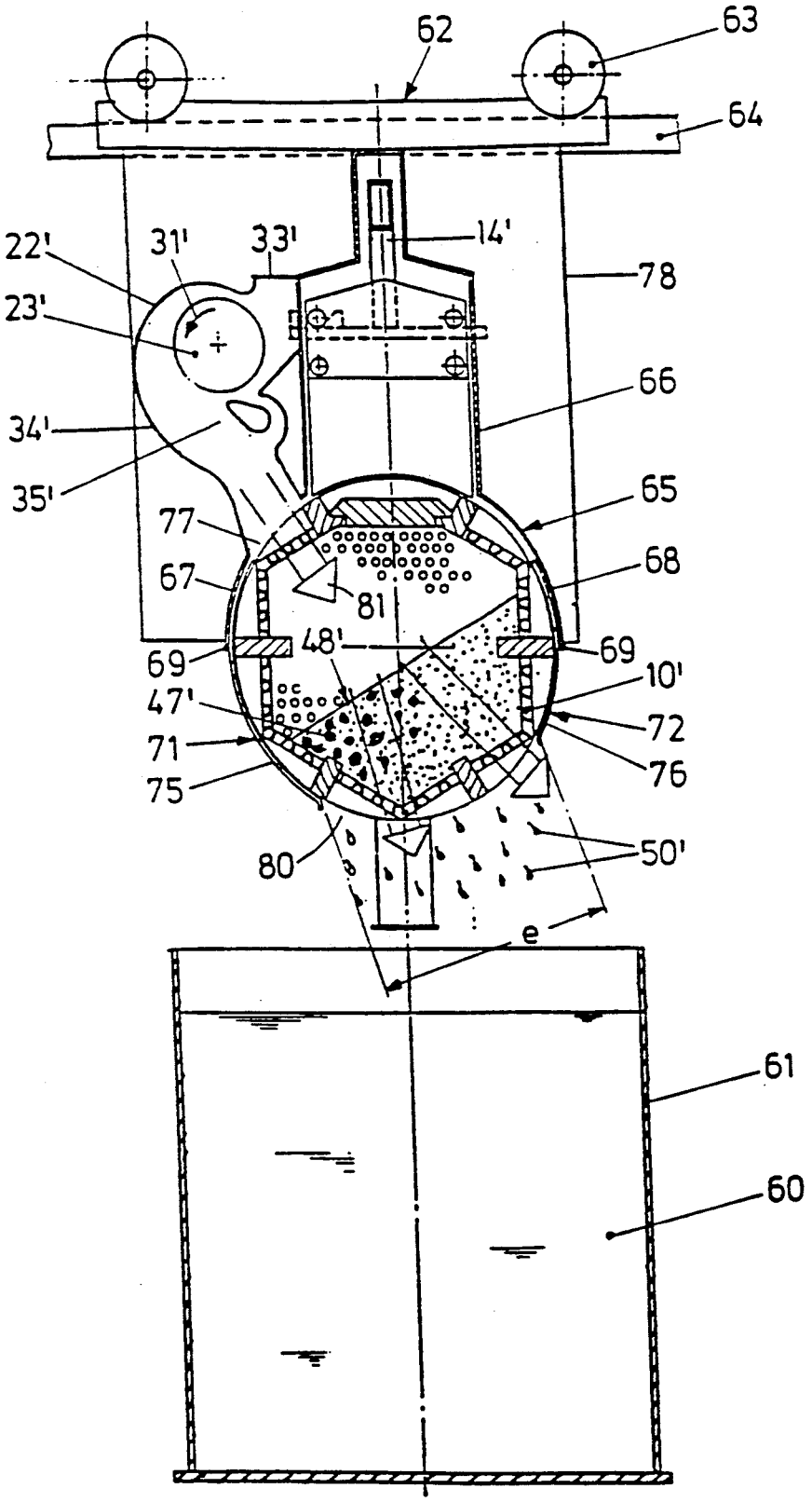
FIG. 5 shows the device according to FIG. 4 with the barrel entered in a partial drying chamber.

With the embodiment according to FIGS. 4 and 5 no complete drying of the charge 48' is desired; rather, the charge 48' located in a barrel 10' is only to be largely freed from a treatment bath solution 60, prior to the barrel 10' with the charge 48' being exposed to another treatment bath solution. The purpose is to avoid that any treatment bath solution 60 contained in a container 61 be carried along into another treatment bath solution contained in another container. In this respect the barrel 10' serves as a dipping barrel. The charge 48' of small pieces 47' contained in it is either chemically or electrolytically treated or only rinsed in the treatment bath solution 60 by circulation. The barrel 10' is rotatingly supported on supporting arms 14', which are in turn secured to a transport carriage 62 in such a way that they can travel in height; the transport carriage is displaceable by means of rollers 63 on rails 64 from one charging station via several containers and, as the case may be, via a dryer to a discharging station. Such a transport carriage 62 displaceable on rails 64 can be used in the same way for the embodiments according to FIGS. 1 to 3. This kind of transport of the barrels 10 or 10', respectively, is generally known in practice.

A partial drying chamber 65 designed as a pressure chamber is arranged on the transport carriage 62. It has an upper drying chamber section 66 followed by pitch cylindrical or partial cylindrical limiting walls 67, 68, which, together with the upper drying chamber section 66, at most enclose a semi-cylinder and which therefore extend over 180° at most. Pitch-cylindrical limiting walls 71, 72 also are pivotably arranged at the lower free longitudinal edges 69 of these limiting walls 67, 68 by means of corresponding swivel hinges 70 within the limiting walls 67, 68, so that the upper sections 73, 74 of the pivotable limiting walls 71, 72 situated between the limiting walls 67, 68 can be pivoted against the inner side of the limiting walls 67, 68, whereby the lower sections 75, 76 of the pivotable limiting walls 71, 72 situated outside the limiting walls 67, 68 can be pivoted to approach one another.

A transverse-flow blower 22' is arranged at the partial drying chamber 65 and has an air inlet nozzle 33' open at the top, i.e. towards the atmosphere. The air outlet nozzle 34' with diffuser 35' following in the direction of rotation 31' of the rotor wheel opens into the partial drying chamber 65 via an air blow-in opening 77 extending over the full length of the barrel 10'. This blow-in opening 77 is located in the upper area of one of the pitch-cylindrical limiting walls 67 adjacent to the upper drying chamber section 66. The upper drying chamber section 66, the pitch-cylindrical limiting walls 67, 68 secured to it, and the transverse-flow blower 22' are in a protective casing 78, which is open at the bottom and equally secured to the transport carriage 62.

When a barrel 10' filled with a charge 48' is moved upwards out of the container 61, i.e. when it is moved from the position shown in FIG. 4 into the positon shown in FIG. 5, then an essential part of the treatment bath solution 60 contained in the barrel 10' drips down into the container 61. As a result of their being hinged as above described the pivotable limiting walls 71, 72—when in the position shown in FIG. 4, where the barrel 10' is not in the partial drying chamber 65—have an opening 79, of which the width c is greater than the double radius r' of the barrel 10'. Upon introduction into the partial drying chamber 65 the end faces 11' of the barrel 10' come to rest against the upper sections 73, 74 of the pivotable limiting walls 71, 72 and pivot the latter towards the outside against the limiting walls 67, 68, whereby the lower sections 75, 76 of these pivotable limiting walls 71, 72 are pivoted against the barrel 10'. Since the diameter d of the cylindrical partial drying chamber 65 about equals the double radius r' of the barrel 10', the end faces 11' at least largely close a front side of the partial drying chamber 65, when the barrel 10' is moved in. The lower sections 75, 76 pivoted against the barrel 10' leave open an air blow-out opening 80, of which the width e is clearly smaller than the double radius r'. Here, too, $r'<e<2r'$ applies. Here, too, $r'<e<1.6'$ should apply, when the charge 48' fills the barrel 10' by less than its half.

When transverse-flow blower 22' is put into operation, an air flow 81 is blown through the air blow-in opening 77 into the barrel 10' over its full length and pressed through the charge 48'. The air together with liquid droplets 50' leaves the partial drying chamber 65 through the lower air blow-out opening 80 and drips into the container placed below. The air is not heated. In this way at least 80% of the treatment bath solution 60 on the small pieces 47' of the charge 48' and on the barrel 10' itself can be blown off. Only a very small part of this treatment bath solution 61 remains and is carried along into the next bath. Such a pre-drying or partial drying may also effected prior to the drying process in a dryer according to the FIGS. 1 to 3.

What is claimed is:

1. A device for an at least partial drying of small pieces (47, 47') present in a charge (48, 48') and wetted with a treatment bath solution, comprising a barrel (10, 10') for taking up the charge (48, 48'), which barrel has end faces (11, 12; 11'), a barrel coat (16) provided with openings (19), and a substantially horizontal central longitudinal axis (15), a drying chamber (9, 65) containing the barrel (10, 10'), which drying chamber has limiting walls (36, 37; 67, 68, 71, 72) arranged parallel to said central longitudinal axis (15), and a blower (22, 22') with means to actuate the barrel (10, 10') with an air flow (45, 46; 81) directed substantially vertically downwards, and with a housing (32) having an air inlet nozzle (33, 33') and an air outlet nozzle (34, 34') leading to an upper area of the barrel (10, 10'), wherein the blower (22, 22') is a transverse-flow blower (22, 22') with a cylindrical rotor wheel (23, 23') provided with blades (25) projecting substantially radially and rotatingly drivable about an axis of rotation (31, 31'), wherein the axis of rotation (31, 31') is arranged substantially parallel to the central longitudinal axis (15) of the barrel (10, 10'), and wherein the length (1) of the rotor wheel (23, 23') substantially equals the length (L) of the barrel (10, 10').

2. A device according to claim 1, wherein said limiting walls (36, 37) are arranged at a distance (a) from the barrel coat (16), so that the air flow is divided in two partial flows (45, 46) surrounding the barrel (10).

3. A device according to claim 1, wherein an air guiding device (51) is provided in the drying chamber (9, 9') forcing the air flow (58, 81) through the barrel (10, 10').

4. A device according to claim 1, wherein the limiting walls (36, 37) pass into the air inlet nozzle (33).

5. A device according to claim 1, wherein the housing (32) of the blower (22, 22') is provided with end faces (42) passing into side walls (43) of the drying chamber (9, 65), which side walls are adjacent to the end faces (11, 12) of the barrel (10).

6. A device according to claim 1, wherein the transverse-flow blower (22, 22') is provided with a diffuser (35, 35') in the proximity of its air outlet nozzle (34, 34').

7. A device according to claim 1, wherein a liquid precipitator (39) is arranged adjacent to the air outlet nozzle (34).

8. A device according to claim 6, wherein a liquid precipitator (39) is arranged adjacent to the air outlet nozzle (34) and wherein the liquid precipitator (39) follows the diffuser (35).

9. A device for an at least partial drying of small pieces (47, 47') present in a charge (48, 48') and wetted with a treatment bath solution comprising:

a barrel (10, 10') for taking up the charge (48, 48'), which barrel has end faces (11, 12; 11'), a barrel coat (16) provided with openings (19), and a substantially horizontal central longitudinal axis (15), a drying member (9, 65) containing the barrel (10, 10'), which drying chamber has limiting walls (36, 37; 68, 71, 72) arranged parallel to said central longitudinal axis (15), and a blower (22, 22') with means to actuate the barrel (10, 10') with an air flow (45, 46; 81) directed substantially vertically downwards, and with a housing (32) having an air inlet nozzle (33, 33') and an air outlet nozzle (34, 34') leading to an upper area of the barrel (10, 10'), wherein the blower (22, 22') is a transverse-flow blower (22, 22') with a cylindrical rotor wheel (23, 23') provided with blades (25) projecting substantially radially and rotatingly drivable about an axis of rotation (31, 31'), wherein the axis of rotation (31, 31') is arranged substantially parallel to the central longitudinal axis (15) of the barrel (10, 10'), wherein the length (1) of the rotor wheel (23, 23') substantially equals the length (L) of the barrel (10, 10').

wherein an air guiding device (51) is provided in the drying chamber (9, 9') forcing the air flow (58, 81) through the barrel (10, 10'), and wherein the air guiding device (51) is substantially formed by a membrane (53) resting against the barrel coat (16), which membrane has an air passage opening (58) facing the air inlet nozzle (33).

10. A device according to claim 9, wherein the membrane (53) elastically rests against a part of the barrel coat (16).

11. A device according to claim 9, wherein the limiting walls (36, 37) pass into the air inlet nozzle (33).

12. A device according to claim 9, wherein the housing (32) of the blower (22, 22') is provided with end faces (42) passing into side walls (43) of the drying chamber (9, 65), which side walls are adjacent to the end faces (11, 12) of the barrel (10).

13. A device according to claim 9, wherein the transverse-flow blower (22, 22') is provided with a diffuser (35, 35') in the proximity of its air outlet nozzle (34, 34').

14. A device according to claim 9, wherein a liquid precipitator (39) is arranged adjacent to the air outlet nozzle (34).

15. A device according to claim 14, wherein a liquid precipitator (39) is arranged adjacent to the air outlet nozzle (34) and wherein the liquid precipitator (39) follows the diffuser (35).

16. A device for an at least partial drying of small pieces (47, 47') present in a charge (48, 48') and wetted with a treatment bath solution comprising:

a barrel (10, 10') for taking up the charge (48, 48'), which barrel has end faces (11, 12; 11'), a barrel coat (16) provided with openings (19), and a substantially horizontal central longitudinal axis (15), a drying chamber (9, 65) containing the barrel (10, 10'), which drying chamber has limiting walls (36, 37; 67, 68, 71, 72) arranged parallel to said central longitudinal axis (15), and a blower (22, 22') with means to actuate the barrel (10, 10') with an air flow (45, 46; 81) directed substantially vertically downwards, and with a housing (32) having an air inlet nozzle (33, 33') and an air outlet (34, 34') leading to an upper area of the barrel (10, 10'), wherein the blower (22, 22') is a transverse-flow blower (22, 22') with a cylindrical rotor wheel (23, 23') provided with blades (25) projecting substantially radially and rotatingly drivable about an axis of rotation (31, 31'), wherein the axis rotation (31, 31') is arranged substantially parallel to the central longitudinal axis (15) of the barrel (10, 10'), wherein the length (1) of the rotor wheel (23, 23') substantially equals the length (L) of the barrel (10, 10'), and wherein the drying chamber (65) is provided on a transport carriage (62) carrying the barrel (10') in suspension and wherein the barrel (10') is introduceable into the drying chamber (65) from below.

17. A device according to claim 16, wherein the drying chamber (65) has limiting walls (67, 68, 71, 72) resting against the barrel coat (16), which limiting walls leave open a lower air blow-out opening (80), for the width (e) of which $r<e<2r$ applies in relation to the radius (r') of the barrel (10').

18. A device according to claim 17, wherein the drying chamber (65) is provided with laterally pivotable, lower limiting walls (71, 72), which, when pivoted open, release an opening (79), of which the width (c) is at least the double radius (r) of the barrel (10').

19. A device according to claim 17, wherein the end faces (11') of the barrel (10') close a front side of the drying chamber (65).

20. A device according to claim 16, wherein the housing (32) of the blower (22, 22') is provided with end faces (42) passing into side walls (43) of the drying chamber (9, 65), which side walls are adjacent to the end faces 11, 12) of the barrel (10).

21. A device according to claim 16, wherein the transverse-flow blower (22, 22') is provided with a diffuser (35, 35') in the proximity of its air outlet nozzle (34, 34').

22. A device for an at least partial drying of small pieces (47, 47') present in a charge (48, 48') and wetted with a treatment bath solution, comprising:

a barrel (10, 10') for taking up the charge (48, 48'), which barrel has end faces (11, 12; 11'), a barrel coat (16) provided with openings (19), and a substantially horizontal central longitudinal axis (15), a drying chamber (9, 65) containing the barrel (10, 10'), which drying chamber has limiting walls (36, 37; 67, 68, 71, 72) arranged parallel to said central longitudinal axis (15), and a blower (22, 22') with means to actuate the barrel (10, 10') with an air flow (45, 46; 81) directed substantially vertically downwards, and with a housing (32) having an air inlet nozzle (33, 33') and an air outlet nozzle (34, 34') leading to an upper area of the barrel (10, 10'), wherein an air guiding device (51) is provided in the drying chamber (9 9') forcing the air flow (58, 81) through the barrel (10, 10'), and wherein the air guiding device (51) is substantially formed by a membrane (53) resting against the barrel coat (16), which membrane has an air passage opening (58) facing the air inlet nozzle (33).

23. A device according to claim 22 wherein the membrane (53) elastically rests against a part of the barrel coat (16).

24. A device according to claim 22, wherein the limiting walls (36, 37) pass into the air inlet nozzle (33).

25. A device according to claim 22, wherein the housing (32) of the blower (22, 22') is provided with end faces (42) passing into side walls (43) of the drying chamber (9, 65), which side walls are adjacent to the end faces 11, 12) of the barrel (10).

26. A device according the claim 22, wherein the transverse-flow blower (22, 22') is provided with a diffuser (35, 35') in the proximity of its air outlet nozzle (34, 34').

27. A device according to claim 22, wherein a liquid precipitator (39) is arranged adjacent to the air outlet nozzle (34).

28. A device according to claim 26, wherein a liquid precipitator (39) is arranged adjacent to the air outlet nozzle (34) and wherein the liquid precipitator (39) follows the diffuser (35).

* * * * *